US006418003B1

(12) United States Patent
Xiang

(10) Patent No.: US 6,418,003 B1
(45) Date of Patent: Jul. 9, 2002

(54) CONTROL METHODS FOR ELECTROMAGNETIC VALVE ACTUATORS

(75) Inventor: Youqing Xiang, Canton, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 94 days.

(21) Appl. No.: 09/612,400

(22) Filed: Jul. 5, 2000

(51) Int. Cl.[7] ..... H01H 47/00
(52) U.S. Cl. ..... 361/172; 361/146
(58) Field of Search ..... 361/139, 143, 361/152, 154, 146, 160, 170–172; 251/129.01, 129.05, 129.1; 123/490, 478; 318/126

(56) References Cited

U.S. PATENT DOCUMENTS 4,593,658 A 6/1986 Moloney
4,629,954 A * 12/1986 Banzai et al. ..... 318/561
4,764,711 A * 8/1988 Deller ..... 318/619
5,069,422 A 12/1991 Kawamura
5,199,394 A 4/1993 Hartmann et al.
5,596,956 A 1/1997 Ogawa et al.
5,782,211 A 7/1998 Kamimaru
5,964,192 A 10/1999 Ishii

OTHER PUBLICATIONS

US 5,775,286, 07/1998, Yanai et al. (withdrawn)

* cited by examiner

*Primary Examiner*—Kim Huynh
(74) *Attorney, Agent, or Firm*—John E. Kajander

(57) ABSTRACT

A method for initializing an actuator valve (12) and controlling the valve (12) using current command control (100) or voltage control including an estimate of back emf (200). A series of low voltage pulses (304) is applied to one of the solenoid coils (20, 24) in the actuator valve (12) according to the natural frequency of the armature (16) movement in the actuator valve (12). The current command control system calculates a desired force ($F_{em}$) and divides the force into closing and opening components $F_{em_c}$, $F_{em_o}$, for calculating a desired current command Ic_cmd, Io_cmd, for each of the solenoid coils. The back emf control system divides the current signal into close and open components, $I_o$, $I_c$, that are individually processed and combined with a back emf estimate for each of the open and close solenoids, $e_c$, $e_o$. The result is a desired voltage command, $v_c$*, $v_o$*, for each of the solenoids that is communicated to the power stage (34) in order to operate the armature (16) as desired.

14 Claims, 5 Drawing Sheets

CONTROL METHODS FOR ELECTROMAGNETIC VALVE ACTUATORS

TECHNICAL FIELD

The present invention relates generally to controlling an electromagnetic valve actuator, and more particularly to control methods for electromagnetic engine valve actuation with variable timing to improve combustion control and fuel economy for an internal combustion engine.

BACKGROUND OF THE INVENTION

Typically in an internal combustion engine, the intake and exhaust valves are controlled mechanically. The valves are tied to the engine's crankshaft and thus there is limited flexibility in the control of the valves. Valve control is extremely important for optimizing fuel economy and reducing polluting emissions. Therefore, flexibility is highly desirable in valve control.

It is known in the art to employ electromagnetically driven valve actuators in an internal combustion engine. Typically, these known systems require power circuits having high frequency switching devices in order to handle the voltage differences required to properly control the valves. Additionally, the control of the valve timing is critical and therefore, is the subject of much consideration.

Improving the timing of the electromagnetically driven valves not only improves the engine's combustion capabilities, but may also reduce the pumping losses for air charging, thereby improving fuel economy and reducing emissions. Determination of the optimum current that should be applied to the opening and/or closing coils, and reducing the amount of excitation current that is required, are ongoing subjects of research.

SUMMARY OF THE INVENTION

It is an object of the present invention to control the electromagnetic engine valve actuation system using current-commanded control. It is another object of the present invention to use back electromotive force (emf) to compensate for nonlinear feedback control.

It is a further object of the present invention to provide an initialization sequence for the above mentioned control techniques that reduces the amount of initialization current required by an actuator.

In carrying out the above objects and other objects and features of the present invention, a method is provided that improves the timing of an electromagnetic valve actuator by improving the valve control. In one embodiment of the present invention, a desired current is calculated based on feedback from the actuator and a power circuit generates the desired current in order to produce the force necessary to operate the actuator. In another embodiment of the present invention the current control method is enhanced by applying estimated back emf in order to calculate a desired voltage. The desired voltage is used to generate the voltage necessary to obtain the desired current, which will ultimately control the actuator. The back emf method of the present invention eliminates the need for any current regulation in the power stage, thereby reducing the size, complexity and ultimately the cost of the power stage.

Additionally an initialization method is provided which reduces the amount of current required to initialize a coil of the actuator. According to the initialization method of the present invention, a sequence of pulses is applied to the closing coil at predetermined intervals in order to enhance the natural frequency of oscillations and thereby generate a sufficient initialization pulse without the need for excessive current. Smaller current requirements will allow a reduction in the size of the closing coil to be realized, thereby increasing packaging space for other applications and at the same time reduce the weight and cost of the electromagnetic valve system.

Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF PREFERRED EMBODIMENTS

Figure 1:
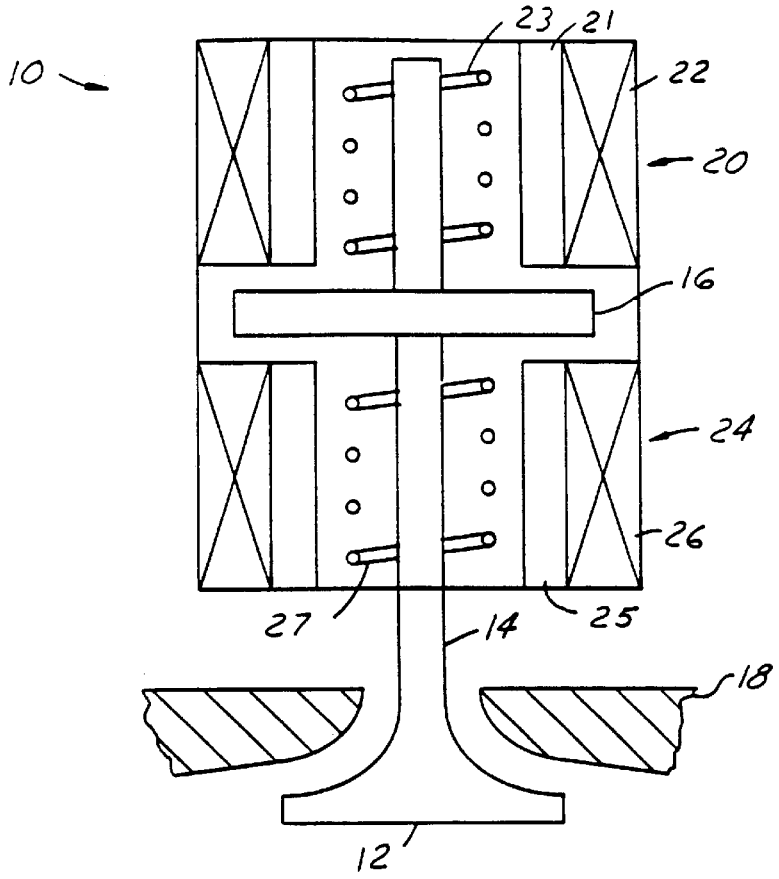
FIG. 1 is a sectional view of an electromagnetically driven intake valve, which is controlled according to an embodiment of the present invention.

FIG. 1 depicts an electromagnetically driven actuator 10 used in conjunction with any of the control methods of the present invention. The actuator 10 has a valve element 12 having a valve stem 14 which has an armature 16 secured thereto. The valve element 12 is slidably mounted in an engine head 18 of a cylinder block (not shown) of an internal combustion engine (not shown). It should be noted that while an intake valve is shown in FIG. 1, the present invention is as applicable to an exhaust valve (not shown). The exhaust valve is similar in construction to the intake valve, except the valve element is mounted in the cylinder block at a location above the engine head for opening and closing an exhaust port.

Referring still to FIG. 1, the valve element 12 is driven by two opposing solenoids 20, 24. The solenoids 22, 24 are opposed to each other in a longitudinal direction. A closing solenoid 20 biases the valve element 12 in a valve closing direction. An opening solenoid 24 biases the valve element in a valve opening direction. The closing solenoid (20) has a core 21 and a coil 22. Likewise the opening solenoid (24) has a core 25 and a coil 26. A spring means 23 is interposed between the closing core 21 and the armature 16. Also, a spring means 27 is interposed between the opening core 25 and the armature 16. The force of spring means 23 and 27 becomes zero when the armature 16 is positioned in a balanced, or neutral, position. The spring means 23 and 27 act to bias the position of the valve element 12 in the opening direction when the armature 16 is positioned upward of the neutral position. And, the spring means 23 and 27 act to bias the position of the valve element 12 in the closing direction when the armature 16 is positioned downward of the neutral position.

Selectively energizing the closing and opening solenoids with a driving current will move the valve element between a fully closed and a fully open position. When neither coil is energized, the valve element remains in a neutral position, intermediate a fully open position and a fully closed position.

Figure 2:
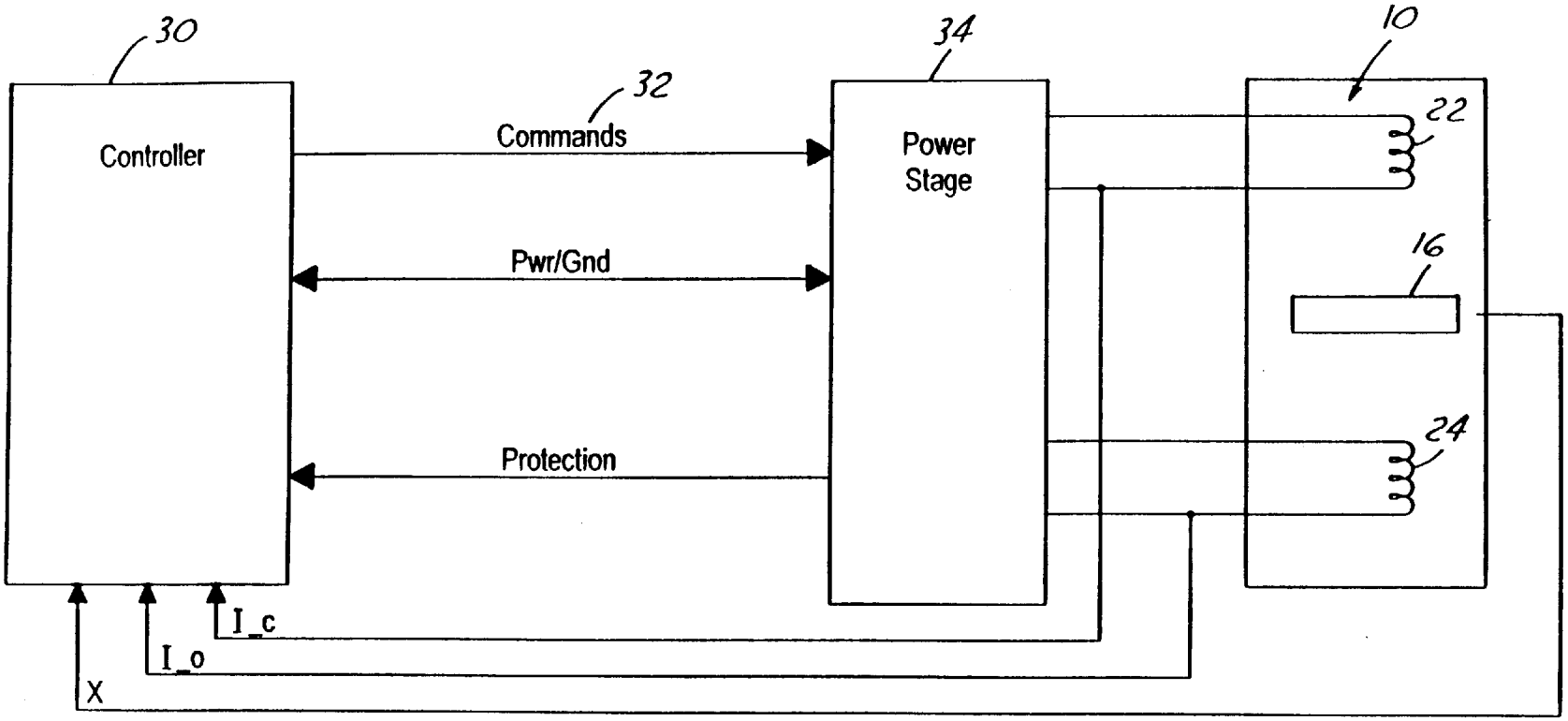
FIG. 2 is a schematic diagram of the electromagnetically driven actuator system controlled according to an embodiment of the present invention.

FIG. 2 schematically shows the arrangement of an entire control system according to any embodiment of the present invention, incorporating the electromagnetic valve 12 shown in FIG. 1. A controller 30 controls the motion of the actuator 10 and the transitions between the fully open and fully closed positions for the valve element. The controller 30 provides commands 32 to a power stage 34 that feeds the correct current and voltage to the open and close solenoids 20 and 24 in the actuator valve. Feedback in the form of opening coil current I_o, closing coil current, I_c and armature position, X, are provided by sensors, not shown, to the controller 30. Any of the embodiments for the control methods described herein can be implemented using the actuator system shown in FIG. 2. It should also be noted that the power stage 34 could include the capability to regulate current.

Figure 3:
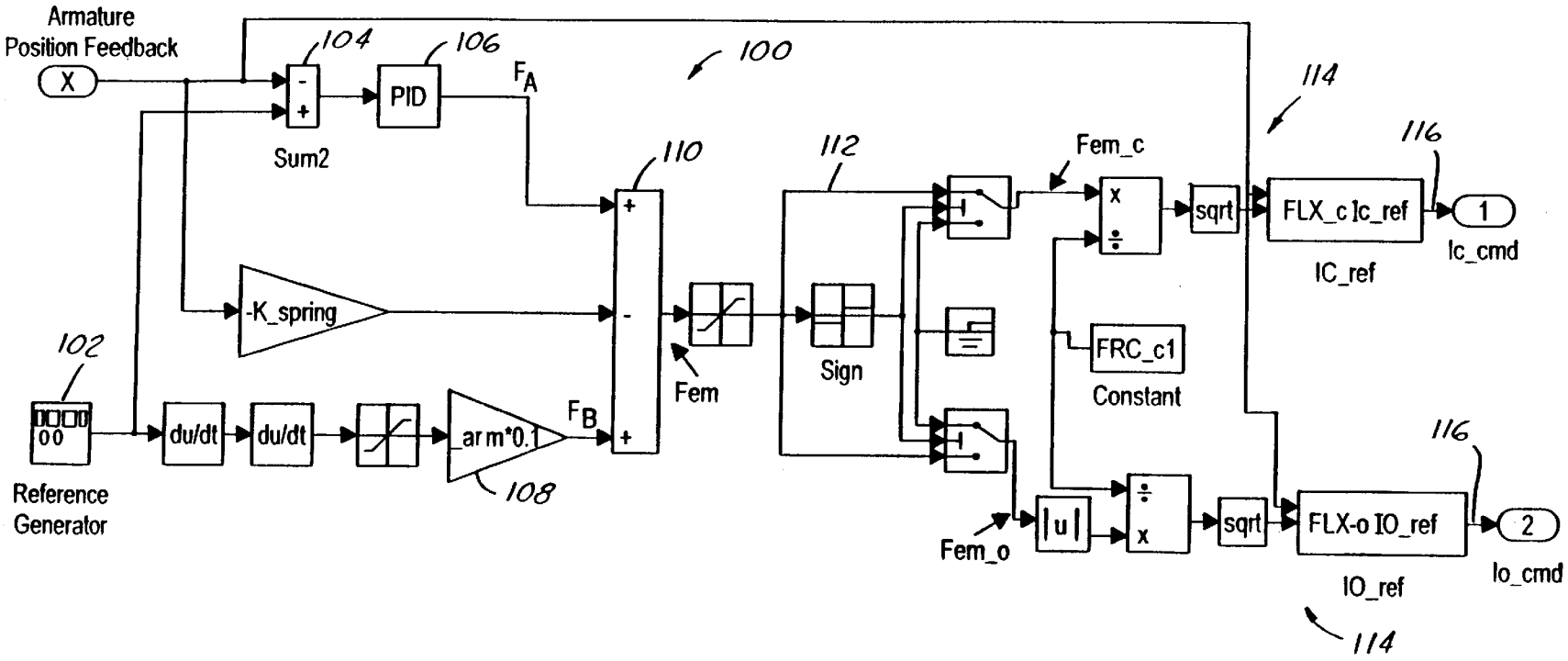
FIG. 3 is a flow diagram of the current commanded control method of the present invention.

FIG. 3 is a flow diagram of the current-commanded control method 100 of the present invention. As discussed above, the power stage (not shown in FIG. 3) has current regulation capabilities to regulate the current supplied to the actuator according to the desired current calculated using this embodiment of the present invention. The current-command control method 100 is executed within the controller of the actuator system. The controller is supplied with the armature position, X, and input from a reference generator 102. The reference generator 102 provides a waveform that is stored in the memory of the controller and represents a profile of the preferred motion of the armature. Typically a sinusoidal profile is preferred.

The armature position feedback, X, and the waveform from the reference generator 102 are summed 104 and processed by a proportional-integral-derivative (PID) controller 106 to generate a force, $F_A$, that represents the force required to move the armature. A spring coefficient, K_spring, provides an estimate of the spring force that must be overcome in order to move the armature. Finally, the output of the reference generator is processed 108 in order to estimate the accelerated force due to the mass of the armature, $F_B$. These three forces, $F_A$, K_spring, and $F_b$ are combined 110 to determine a desired force, $F_{em}$, which is the electromagnetic force needed to move the armature as desired. The desired force is divided 112 into two components, a closing force, $F_{em_c}$, and an opening force, $F_{em_o}$. The division is made based on the sign of the component. The positive component represents the closing force and the negative component represents the opening force. Each component of the force is individually processed 114 in conjunction with a fixed constant, FRC_c1, which is generated using a model of the actuator. One skilled in the art is capable of generating this constant, and therefore, the mechanics will not be described herein.

The method 100 of the present invention produces 116 two current commands. A closing current-command, Ic_cmd, is generated by manipulation of the closing force component of the desired force. An opening current-command, Io_cmd, is generated by manipulation of the opening force component of the desired force. Referring back to FIG. 2, these two current commands are communicated from the controller 30 to the power stage 34 by way of the commands 32 in order to provide the actuator 10 with the current necessary to move the armature as desired.

Figure 4:
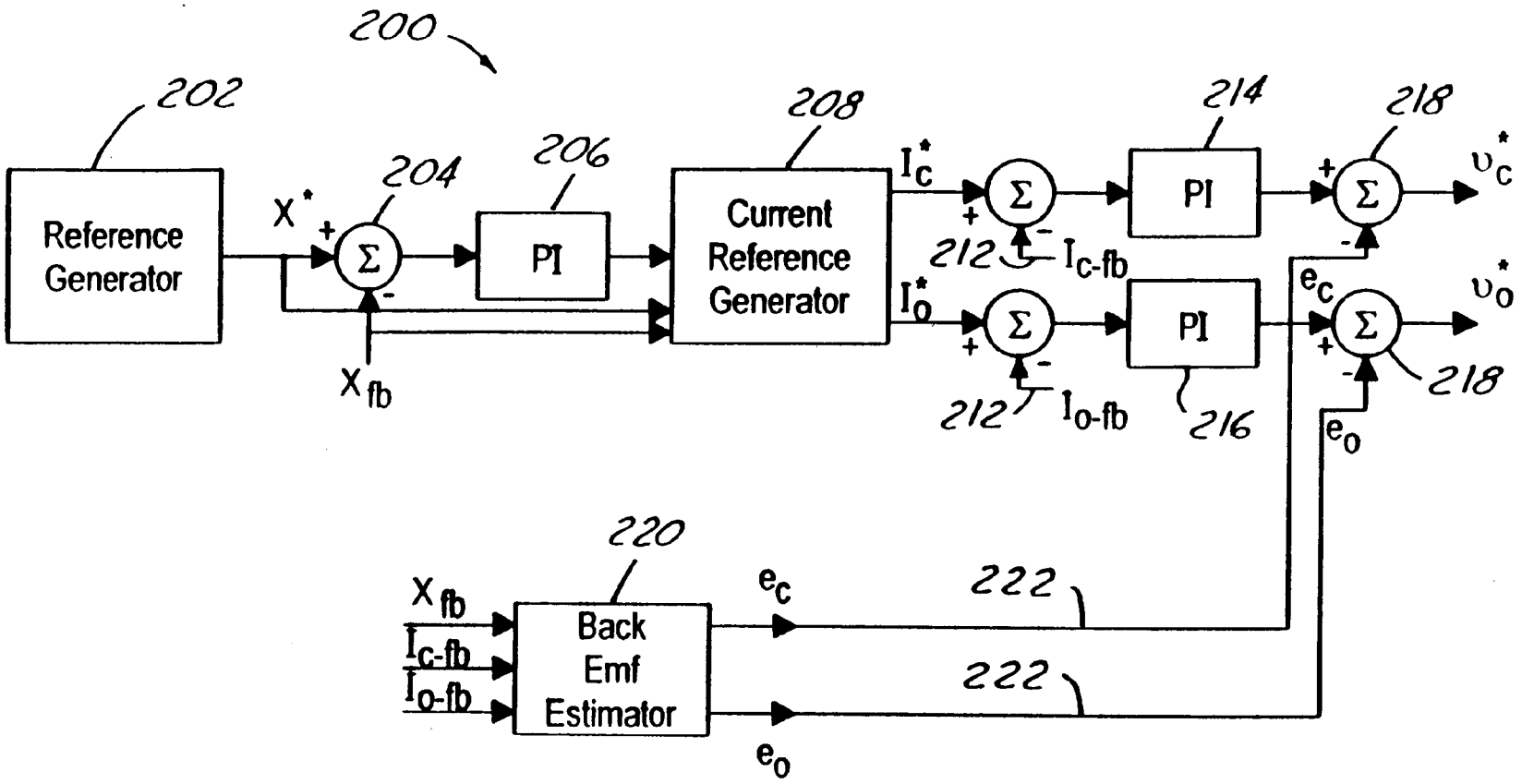
FIG. 4 is a flow diagram of the back emf compensated voltage control method of the present invention.

FIG. 4 is a flow diagram of another embodiment of the present invention, and provides an enhancement of the current-commanded method. The method is a back emf voltage control method 200. The back emf voltage control method 200 controls the power stage such that a voltage, $v_c$* and $v_o$*, is generated to obtain a desired voltage calculated in the controller. In the present embodiment, 200, the need for a current regulator in the power stage is eliminated. The back emf voltage control method 200 of the present invention provides more flexibility in the controller.

The armature position feedback, $X_{fb}$, and a waveform from a reference generator 202 are summed 204 and processed 206 by a PI controller. As in the current command method discussed above the current is divided 210 into two components, $I_c$* and $I_o$*. However, in this embodiment, a current reference generator 208 is used to divide the current. Feedback current for each of the coils, $I_{c\text{-}fb}$ and $I_{o\text{-}fb}$, is fed 212 into individual PI controllers 214, 216. The output is summed 218 with outputs $e_o$ and $e_c$ from a back emf estimator 220. The result is a desired voltage component for each of the coils, $v_c$* and $v_o$* being provided to the controller for producing the command voltage needed to actuate the valve.

According to the back emf voltage control method 200, the back emf in each coil is estimated 220 and used to calculate 222 a desired voltage. The desired voltage is communicated to the power stage, where the power stage generates the commanded voltage. The current is regulated by software in the controller.

Figure 5:
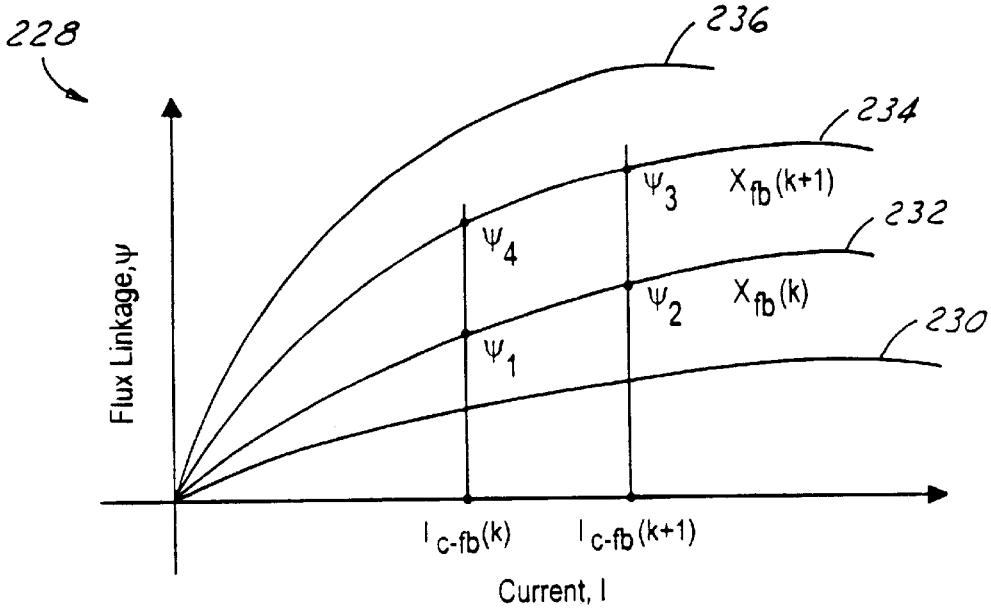
FIG. 5 is a graph of the flux linkage vs. the current for the back emf estimator.

There are several ways to estimate 220 the back emf. In particular, one method that can be used is to store the flux linkage, Ψ, for the closing coil as a function of armature position and coil current. The flux linkage is stored as a two-dimensional look up table and can be shown graphically 228, as in FIG. 5. The x-axis represents the current, I, and the y-axis represents the flux linkage, Ψ. The curves 230, 232, 234, and 236 represent the armature position. At two sampling points, there is shown $x_{fb}(k)$, $x_{fb}(k+1)$, $I_{c\text{-}fb}(k)$ and $I_{c\text{-}fb}(k+1)$. From the look-up table, there is:

$$\Psi_1=\Psi(I_{c\text{-}fb}(k),\ x_{fb}(k))$$

$$\Psi_2=\Psi(I_{c\text{-}fb}(k+1),\ x_{fb}(k)),\ \text{and}$$

$$\Psi_3=\Psi(I_{c\text{-}fb}(k+1),\ x_{fb}(k+1))$$

The back emf is represented by the formula:

$$e_c = \frac{\Psi_3 - \Psi_2}{\Delta t}$$

where Δt is the sampling period. The same method can be used to estimate the open coil back emf, $e_o$.

$$e_o = \frac{\Psi(I_{c-fb}(k+1),\ x_{fb}(k+1)) - \Psi(I_{c-fb}(k+1),\ x_{fb}(k))}{\Delta t}$$

In the alternative, back emf can be estimated for both the open and close coils as:

$$e = \frac{\Psi_4 - \Psi_1}{\Delta t}$$

where $\Psi_4=\Psi(I_{c\text{-}fb}(k),\ x_{fb}(k+1))$, or $\Psi_4(I_{o\text{-}fb}(k),\ x_{fb}(k+1))$. When the sampling period, Δt, is small enough, the two estimates should be very close.

As discussed above, the output from the back emf estimator 220 is summed 218 to produce the desired voltages that will be communicated to the controller for the actuator.

In another embodiment of the present invention an initialization method is provided. It is particularly applicable to the current-command method 100 and will be described herein in conjunction therewith. However, it is possible to apply to the initialization method to the other control methods as well. The only difference is that in the back emf control method, the current regulation will be accomplished through software control in the controller, whereas for the current-command method, a current regulator accomplishes current regulation in the power stage.

Figure 6:
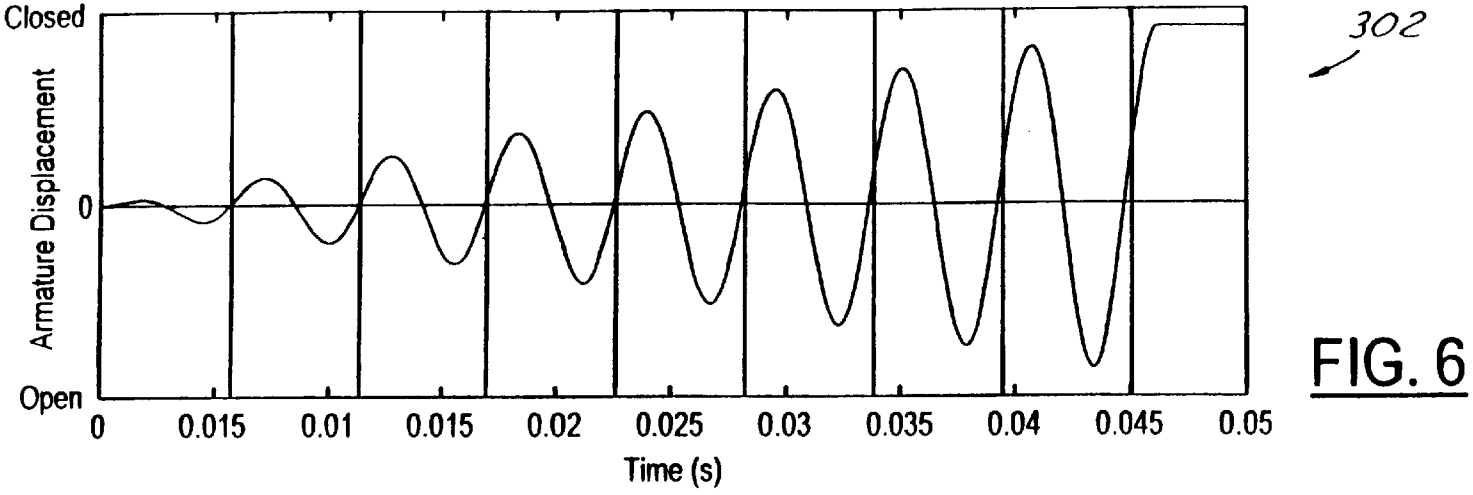
FIG. 6 is a graph showing the armature position response according to the initialization method of the present invention.

Referring to FIG. 6 there is shown the position response 302 of an armature to the initialization method of the present invention. It is shown that the armature oscillates from a low level to the desired initialization level over a predetermined period of time. In the prior art, it is typical to apply a very high current to the armature in order to initialize the armature position. It is also known to use both the opening and closing coils to accomplish initialization.

Figure 7:
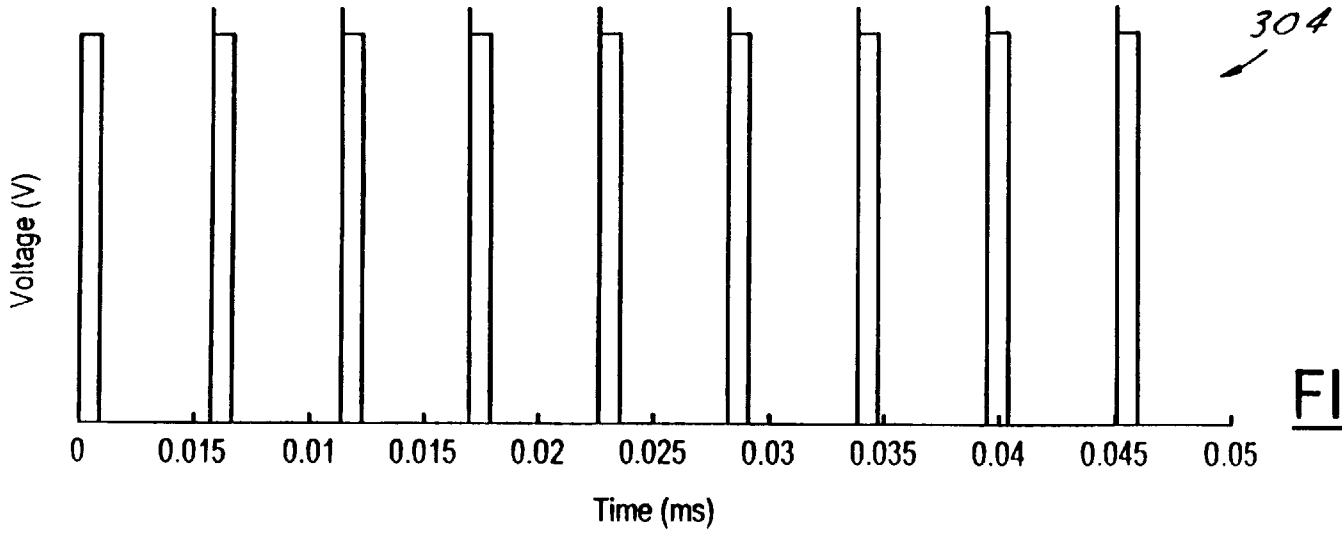
FIG. 7 is a graph showing the excitation voltage for either the opening coil, or the closing coil, according to the initialization method of the present invention.

In the method of the present invention, only one coil is used to accomplish initialization. The armature has a natural frequency that is enhanced by the application of pulses, as shown graphically 304 in FIG. 7, at predetermined intervals during the oscillation cycle, in order to enhance the amplitude of the oscillation. Working in conjunction with the natural frequency of the armature, it is possible to apply low voltage pulses, which means lower current, during the initialization process.

In the preferred embodiment, only the closing coil is used for the initialization of the actuator. Typically, the closing coil requires higher power rating to move the armature because the armature is held at the closed position at about 75% duty cycle. Therefore, the closing coil is typically the larger of the two coils in the actuator. By applying the initialization method of the present invention, the opening coil, and the driving circuit associated therewith, can be significantly reduced in size and therefore, significant cost and space savings will be realized. It should be noted that while the preferred embodiment is to apply the initialization method 400 to the closing coil, similar results are accomplished when the method is applied to the opening coil instead. However, the benefits to space and weight savings are not as significant as when the method is applied to the larger closing coil.

The invention covers all alternatives, modifications, and equivalents, as may be included within the spirit and scope of the appended claims.

What is claimed is:

1. A method for generating a current command to a controller for an electromagnetic valve actuator system having a controller, a power stage and an electromagnetic actuator having an armature therein, said method comprising the steps of:

supplying said controller with a feedback signal from the position of the armature, a reference waveform representing a desired movement for the armature, and a spring force constant;

processing said position feedback signal, said reference waveform and said spring coefficient to generate a desired force, $F_{em}$;

dividing said desired force, $F_{em}$ into a closing force component, $F_{em_c}$, and an opening force component, $F_{em_o}$;

individually processing each component with a fixed constant to produce a closing current command, Ic_cmd and an opening current command, Io_cmd; and communicating said current commands from the controller to the power stage for generating the current necessary to move the armature.

2. The method as claimed in claim 1 wherein said step of processing said position feedback signal, said reference waveform and said spring force constant further comprises the steps of:

summing said position feedback signal, and said reference waveform;

processing said summation with a proportional-integral-derivative controller to produce a force, $F_A$, necessary to move the armature, processing said reference waveform to produce an estimate of an accelerated force, $F_B$, due to the mass of the armature;

combining said spring coefficient, said accelerated force, $F_B$, and said force, $F_A$, to produce said desired force, $F_{em}$.

3. The method as claimed in claim 1 wherein said step of individually processing each force component further comprises the step of generating said fixed constant by mathematically modeling movement of the armature.

4. A method for generating a desired voltage command for an electromagnetic valve actuator system having a controller, a power stage and an electromagnetic actuator having an armature therein and opposing opening and closing solenoids, said method comprising the steps of:

summing a position feedback signal for the armature and a reference waveform representing a desired armature motion;

processing said summation by a proportional-integral controller to obtain a current signal;

dividing said current signal into a closing current component and an opening current component;

summing said closing current component with a closing current feedback signal;

processing said summed signal by a proportional-integral controller to obtain voltage signal;

combining said voltage signal with an estimated back emf for the closing solenoid to obtain a desired closing voltage signal, summing said opening current component with an opening current feedback signal;

processing said summed signal by a proportional-integral controller to obtain a voltage signal;

combining said voltage signal with an estimated back emf for the opening solenoid to obtain a desired opening voltage signal;

communicating said closing voltage signal and said opening voltage signal to the power stage.

5. The method as claimed in claim 4 wherein said step of dividing said current signal further comprises dividing said current signal through software generated current regulation.

6. The method as claimed in claim 4 wherein said steps of estimating back emf for the opening and closing solenoids further comprises:

storing a flux linkage, $\Psi$, for one of the solenoids as a function of armature position and coil current;

sampling said flux linkage for at least two points in time;

estimating a back emf as a function of flux linkage, $\Psi$, and a sampling period, $\Delta t$.

7. The method as claimed in claim 6 wherein said back emf is estimated for the closing solenoid and is represented by:

$$e_c = \frac{\Psi_3 - \Psi_2}{\Delta t}.$$

8. The method as claimed in claim 6 wherein said back emf is estimated for the opening solenoid and is represented by:

$$e_o = \frac{\Psi(I_{c-fb}(k+1), x_{fb}(k+1) - \Psi(I_{c-fb}(k+1), x_{fb}(k))}{\Delta t}.$$

9. The method as claimed in claim 6 wherein said back emf is represented by:

$$e = \frac{\Psi_4 - \Psi_1}{\Delta t}.$$

10. The method as claimed in claim 9 wherein said back emf is estimated for the closing solenoid and $\Psi_4=\Psi(I_{c\text{-}fb}(k), x_{fb}(k+1))$.

11. The method as claimed in claim 9 wherein said back emf is estimated for the opening solenoid and $\Psi_4(I_{o\text{-}fb}(k), x_{fb}(k+1))$.

12. An electromagnetic actuator valve system for generating a current command comprising:

an electromagnetic actuator having an armature therein;

a controller in communication with a power stage, said controller being supplied with a feedback signal from the position of the armature, a reference waveform representing a desired movement for the armature and a spring constant, said feedback signal, said reference waveform and said spring constant are processed in said controller to generate a desired force, $F_{em}$, having an opening force component, $F_{em_o}$, and a closing force component, $F_{em_c}$, said closing force component and said opening force component being processed by said controller with a fixed constant to generate a closing current command, Ic_cmd and an opening current command, Io_cmd, said power stage for supplying power to said electromagnetic actuator, said power stage being supplied with said opening current command and said closing current command from said controller for generating the current necessary to move said armature.

13. The system as claimed in claim 12 wherein said desired force component $F_{em}$, further comprises:

a summation of said feedback signal and said reference waveform;

proportional-integral-derivative control of said summation to produce a force necessary to move said armature, $F_a$;

an estimated accelerated force, $F_B$, based on a mass of said armature;

whereby said desired force, $F_{em}$ is a combination of said spring coefficiecnt, said accelerated force, $F_B$, and said force, $F_A$.

14. The system as claimed in claim 12 wherein said fixed constant is derived from a mathematical model of said armature.

* * * * *